United States Patent [19]

Krauter et al.

[11] Patent Number: 5,065,729

[45] Date of Patent: Nov. 19, 1991

[54] CYLINDER RECOGNITION APPARATUS FOR A DISTRIBUTORLESS IGNITION SYSTEM

[75] Inventors: Immanuel Krauter, Erbstetten; Winfried Klötzner, Maulbronn-Schmie, both of Fed. Rep. of Germany

[73] Assignee: Robert Bosch GmbH, Stuttgart, Fed. Rep. of Germany

[21] Appl. No.: 573,194

[22] PCT Filed: Mar. 18, 1988

[86] PCT No.: PCT/EP88/00221

§ 371 Date: Jul. 23, 1990

§ 102(e) Date: Jul. 23, 1990

[87] PCT Pub. No.: WO89/08778

PCT Pub. Date: Sep. 21, 1989

[51] Int. Cl.[5] ..... F02P 7/03; F02P 15/08; F02P 17/00

[52] U.S. Cl. ..... 123/643; 73/115; 324/380; 123/637

[58] Field of Search ..... 123/609, 618, 636, 637, 123/643, 644, 652; 73/115, 116; 324/378, 380, 391

[56] References Cited

U.S. PATENT DOCUMENTS

| | | | |
|---|---|---|---|
| 3,901,205 | 8/1975 | Brungsberg | 123/644 |
| 4,101,859 | 7/1978 | Reeves et al. | 324/380 X |
| 4,186,337 | 1/1980 | Volk et al. | 324/380 |
| 4,380,989 | 4/1983 | Takaki | 123/609 X |
| 4,711,119 | 12/1987 | Hamren | 73/115 |
| 4,724,702 | 2/1988 | Hamren | 73/115 |
| 4,915,086 | 4/1990 | Ciliberto et al. | 123/644 X |
| 4,951,628 | 8/1990 | Matsuoka et al. | 123/414 |
| 4,987,770 | 1/1991 | Nanyoshi et al. | 73/115 |

FOREIGN PATENT DOCUMENTS

| | | |
|---|---|---|
| 0177145 | 4/1986 | European Pat. Off. . |
| 0272225 | 6/1988 | European Pat. Off. . |
| 2831188 | 1/1980 | Fed. Rep. of Germany . |
| 3325308 | 1/1985 | Fed. Rep. of Germany . |
| 2129715 | 10/1972 | France . |

*Primary Examiner*—Willis R. Wolfe
*Attorney, Agent, or Firm*—Michael J. Striker

[57] ABSTRACT

A distributorless ignition system using a dual-spark ignition coil generates a signal indicative of which of the two cylinders associated with the dual-spark coil is operating in its power stroke by means of a single detector connected to a predetermined one of the cylinders. The output of the detector is fed to a sample and hold circuit which supplies the peak value from the detector to the control unit of the ignition system where the peak value is evaluated and identified by comparison to a previously obtained peak value. The control unit indicates that the predetermined cylinder is in its power stroke when the detected peak value signal is at its higher level. Conversely, when the peak value signal is at its lower level the control unit determines that it is the other of the two cylinders which is in its lower stroke and signals this accordingly.

7 Claims, 2 Drawing Sheets

CYLINDER RECOGNITION APPARATUS FOR A DISTRIBUTORLESS IGNITION SYSTEM

BACKGROUND OF THE INVENTION

The present invention relates to a distributorless ignition system for an internal combustion engine and more particularly to an apparatus for generating signals for identifying in which cylinder of the engine an ignition event is occurring.

Distributorless ignition systems for internal combustion engines are already known. These systems dispense with mechanical (rotary) distribution of the high tensions sparks and are usually used in combination with other electronic open or closed loop systems such as fuel injection systems where a timing signal is required for controlling the operation of a fuel injection system to sequentially inject fuel for each cylinder in synchronism with the rotation of the engine. In one type of distributorless ignition system, the distribution of high-voltage pulses is accomplished statically by selective triggering of ignition coils, each of which produces two high-voltage sparks simultaneously. One spark acts during the power stroke of one cylinder and the other spark acts during the exhaust stroke of another cylinder.

With this type of static distribution, there exists the need to detect the cylinder which is in its power stroke. One way of carrying out the detection electronically is disclosed in EP-A-177145 where the two simultaneous sparks are both detected and the voltage levels of the detection signals directly compare in a gated comparator. The output of the comparator is used to control a monostable multivibrator which generates a pulse when an ignition event occurs in a selected one of the two cylinders involved. No pulse is generated at the output of the monostable multivibrator when an ignition event occurs in the other of the two cylinders involved.

The disadvantages of this prior arrangement is that two detectors and a considerable amount of circuitry are required and it is still necessary to logically process the gating signal to the comparator and the output from the monostable multivibrator in order to determine in which of the two cylinders an ignition event has occurred.

SUMMARY OF THE INVENTION

It is an object of the present invention to provide a cylinder recognition apparatus which is simpler than the currently known cylinder recognition apparatus.

The present invention provides cylinder recognition apparatus for a distributorless ignition system comprising ignition control means for generating ignition signals, a signal distributor connected to the ignition control means and arranged to be connected to ignition coils associated with two cylinders, detection means for generating a signal indicative of spark generation in a cylinder of an internal combustion engine, processing means for processing the signal generated by the detection means, and control circuit responsive to the processing means for outputting a control signal indicative of the cylinder which is operating in the power stroke of the cycle of the engine, characterised in that the detection means comprises a single detector for detecting the output pulse from the signal distributor to one of the two cylinders of the engine, in that the processing means comprises a circuit for generating a signal representing the peak amplitude of the signal generated by the detection means, and in that there is further provided means for evaluating the magnitude of the peak amplitude detected by the peak value circuit to determine whether said one of the two predetermined cylinders is in a power or exhaust stroke condition.

An advantage of the present invention is that it simplifies the circuitry as compared with that disclosed in EP 177,145 and only requires the use of one detector.

BRIEF DESCRIPTION OF THE DRAWING

Features and advantages of the present invention will be more readily understood from the following description of an embodiment thereof given by way of example with reference to the accompanying drawings, in which.

DETAILED DESCRIPTION OF THE INVENTION

Figure 1:
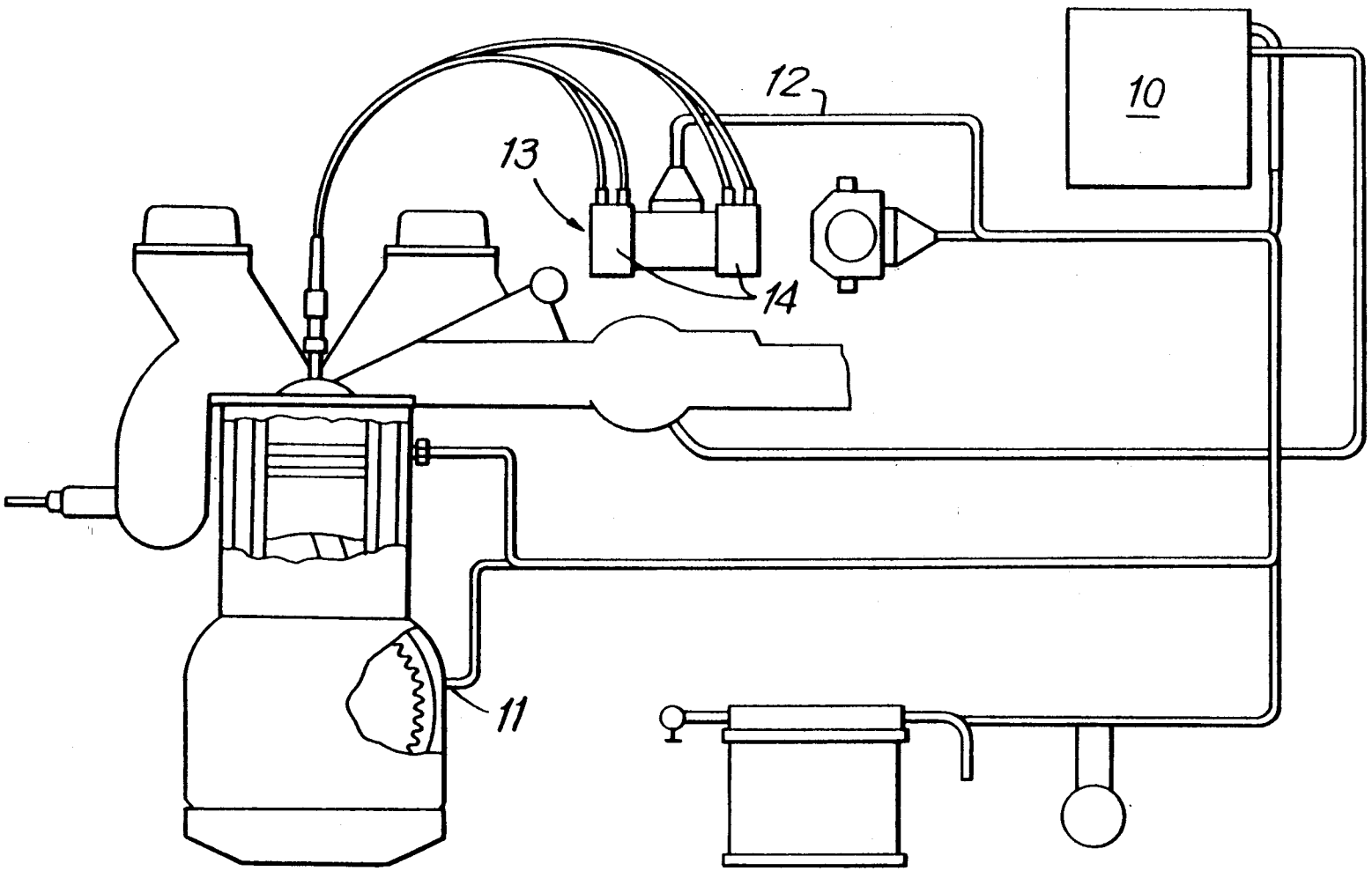
FIG. 1 shows diagrammatically a distributorless ignition system.

One form of distributorless ignition system is shown diagrammatically in FIG. 1 connected to an engine which is itself shown in end view so that only one of the four cylinders of the engine is in fact visible. In FIG. 1, the distributorless ignition system comprises a control unit 10 including an ignition control means ICM which receives engine speed and reference signals from the sensor 11 and sends an ignition signal via a control line 12 to a static high-voltage distributor 13. The distributor 13 includes two power output stages 14 and two ignition coils 14'. Each of the output stages has an ignition coil 14' and each end of the ignition coil is connected to a respective spark plug such that when an ignition coil 14 is operated a high-voltage output are generated, this causes two sparks of different polarity to be generated simultaneously in the spark plugs associated with the ignition coils.

Figure 2:
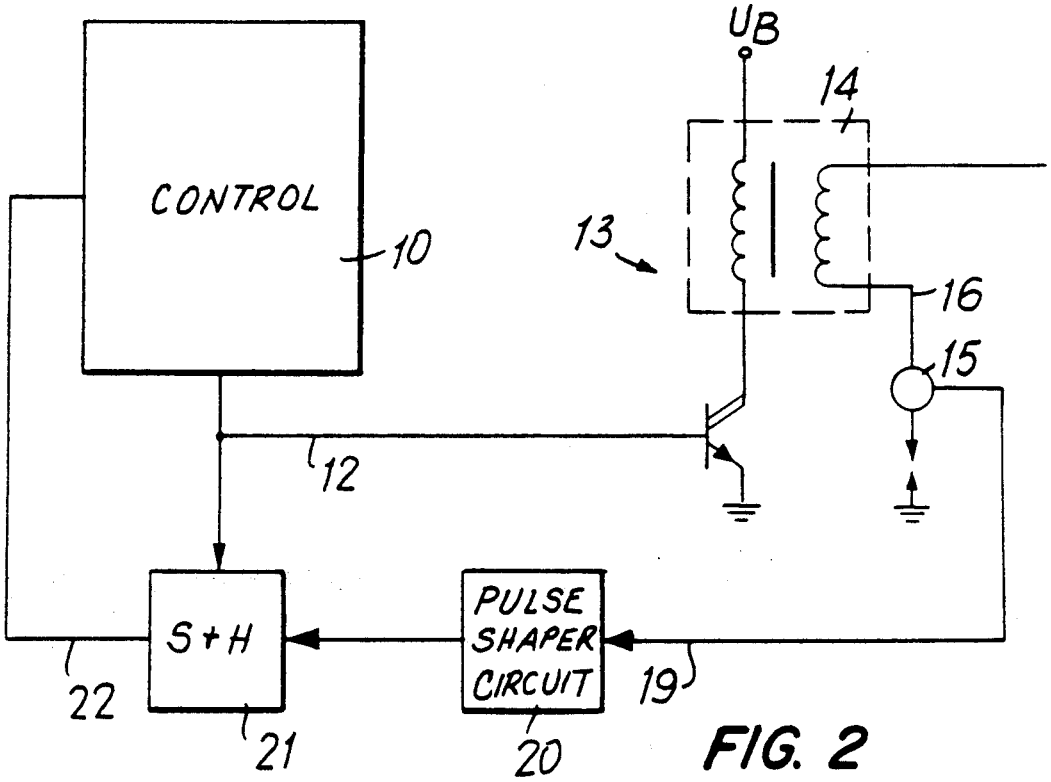
FIG. 2 shows a block diagram of part of the electrical circuitry shown in FIG. 1 and incorporating the present invention.

Turning now to FIG. 2 which shows a block diagram of a part of the ignition system shown in FIG. 1, the same reference numerals are used for the same parts for convenience. In this arrangement, an inductive detector 15 is provided for sensing the voltage in the high-voltage line 16 between one end of the high-voltage output of one of the ignition coils 14' and a spark plug 3. It is to be noted that the other high-voltage line from the ignition coil 14' to the other spark plug is not provided with a detector. The reason for this will be explained in more detail below. The signal from the detector 15 is fed via a line 19 to a pulse shaper circuit 20 and thence to a peak value detection circuit in the form of a sample and hold circuit 21. The output of the sample and hold circuit is fed via a line 22 to the control unit 10.

Figure 3:
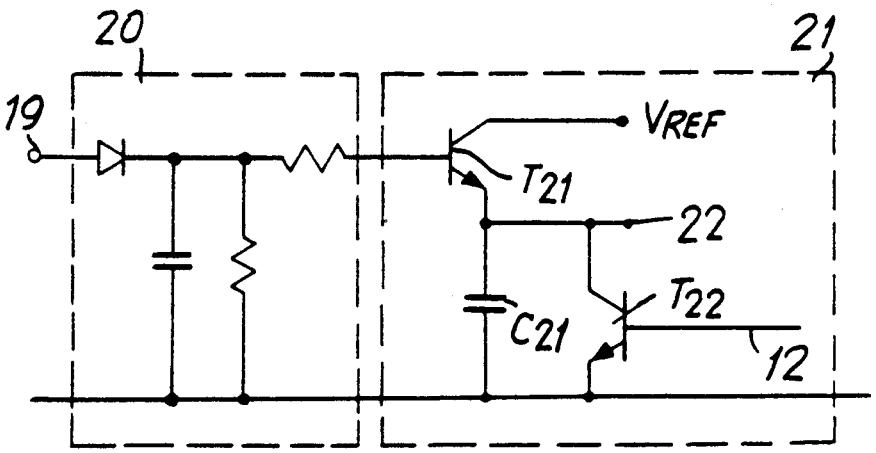
FIG. 3 shows a circuit diagram of part of the block diagram shown in FIG. 2.

The pulse shaper 20 and sample and hold circuit 21 are shown in more detail in FIG. 3 where again the same reference numerals are used for the same parts. From FIG. 3, it will be seen that the pulse shaper 20 comprises a simple diode-capacitor-resistor arrangement which overcomes the difficulties resulting from the fact that the signal on the line 19 exists for only a short period of time. This diode-capacitor-resistor arrangement includes a capacitor $C_{20}$ and resistor $R_{21}$ connected in parallel and a diode $D_{20}$ receiving the pulse along line 19 as well as a resistor $R_{22}$. Further the peak value detector is in the form of a series connected transistor T21 and capacitor C21. The transistor T21 also provides overvoltage protection. Since the signal to be measured has an extremely steep edge, the transistor T21 is selected so as to conduct current from its base to its collector as soon as the transistor reaches its saturated operating region. A transistor T22 is connected in parallel with the capacitor C21 and operated via a control signal from the control unit 10 on its output line 12. The transistor T21 has the single function of re-setting the peak value detection circuit 21 to zero by an other ignition output after the A/D conversion of the potential output on line 22. Alternatively, it is possible for a special control signal to be sent to the transistor T22 after the value fed by the sample and hold circuit 21 to the control unit has been evaluated by an analog to digital converter associated with the control unit 10.

In the operation of the type of distributorless ignition system described above, two sparks are generated by the ignition coil in response to a single control signal from the ignition control means ICM the control unit 10 on the output line 12. Consequently, for any one cylinder spark flashovers are generated twice every four stroke cycle of the cylinder i.e. alternately during the exhaust stroke and during the transition between the compression stroke and the power stroke. In general, the breakdown voltage is much less during the exhaust stroke than during the compression/power stroke due to the difference in pressure in the cylinder. For this reason, two successive analog to digital-converted peak values from the sample and hold circuit 21 are presented to the microprocessor in the control unit 10. The processor recognises that the higher peak value indicates that the cylinder in question is in its compression/power stroke and control circuitry at least partial contained in the processor can trigger ancillary control equipment e.g. fuel injection equipment accordingly. Equally, it recognises the lower peak value signal as indicating that the other cylinder is in its compression/power stroke and again can react accordingly. However, this basic assumption of cylinder condition is not unambiguous for all operating conditions of the engine since the amplitude allocation can reverse in some operational conditions such as, for example, over-run. For this reason, the control unit is arranged to operate in the above manner only in unambiguous operating conditions such as, for example, full or part load or idling.

In special cases which can be encountered and in which starting does not take place at normal cranking speeds but at high engine speeds e.g. during down-hill running in the over-run phase, parallel injection of fuel into the cylinders is first used rather than sequential injection. When changing from over-run to part load, the system is then synchronised as described above.

Various modifications may be made to the above described circuitry. The detector 15 may be a capacitive detector rather than an inductive detector. Further, ignition systems using dual-spark and four-spark coils require two separate power output stages. The engine speed and reference signal generator determines which of the two output stages is triggered at a given time.

It will be understood that each of the elements described above, or two or more together, may also find a useful application in other types of structures differing from the types described above.

While the invention has been illustrated and described as embodied in a cylinder recognition apparatus for a distributorless ignition system, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

We claim:

1. In a cylinder recognition apparatus for a distributorless ignition system of an internal combustion engine having at least two cylinders operating in a plurality of cycles, each of said cycles having a power stroke and an exhaust stroke, comprising ignition control means for generating a plurality of ignition signals, a signal distributor connected to the ignition control means and arranged to be connected to ignition coils associated with two of the cylinders, detection means for generating a signal indicative of spark generation in one of the cylinders of the internal combustion engine, processing means for processing the signal generated by the detection means, and control circuitry responsive to the processing means for outputing a control signal indicative of the cylinder which is operating in the power stroke of the cycle of the engine, said detection means having a single detector for detecting an output pulse from the signal distributor to one of the two cylinders of the engine the improvement wherein said processing means comprises a peak value circuit for generating a peak value signal representing the peak amplitude of the signal generated by the detection means, and further comprising means for evaluating a magnitude of the peak value signal of the peak amplitude detected by the peak value circuit in one of the cycles to determine whether said one of the two predetermined cylinders is in one of a power stroke condition and an exhaust stroke condition.

2. The improvement as defined in claim 1, wherein the peak value circuit comprises a sample and hold circuit.

3. The improvement as defined in claim 1, further comprising means for generating a reset signal connected to the peak amplitude circuit, said means for generating said reset signal being structured for resetting the peak amplitude circuit.

4. The improvement as defined in claim 1, wherein the processing means further comprises a pulse shaping circuit for shaping the output of the detection means, the pulse shaping circuit being connected to an input to the peak amplitude circuit.

5. The improvement as defined in claim 1, wherein the detection means is an inductive detection device.

6. The improvement as defined in claim 1, wherein said means for evaluating is structured to compare two successively-received peak value signals to determine whether said one cylinder is in said one of said power stroke condition and said exhaust stroke condition.

7. Cylinder recognition apparatus for a distributorless ignition system of an internal combustion engine having at least two cylinders operating in a cycle, each of said cycles having a power stroke and an exhaust stroke, said ignition system including ignition control means for generating a plurality of ignition signals and a signal distributor connected to the ignition control means and arranged to be connected to ignition coils associated with two of the cylinders, said cylinder recognition apparatus comprising detection means for generating a signal indicative of spark generation in one of the cylinders of the internal combustion engine, said detection means having a single detector for detecting an output pulse from the signal distributor, processing means for processing the signal generated by the detection means, said processing means comprising a pulse shaping circuit for shaping the signal from the detection means and a sample and hold circuit following the pulse shaping circuit for generating a peak value signal representing the peak amplitude of the signal generated by the detection means, the pulse shaping circuit being connected to an input of the peak amplitude circuit, means for evaluating a magnitude of the peak value signal of the peak amplitude detected by the peak value circuit in one of the cycles to determine whether said one of the two predetermined cylinders is in one of a power stroke condition and exhaust stroke condition, said means for evaluating structured to compare two successively-received peak value signals to determine whether said one cylinder is in said one of said power stroke condition and said exhaust stroke condition, and control circuitry responsive to the processing means for outputing a control signal indicative of the cylinder which is operating in the power stroke of the cycle of the engine.

* * * * *